US006020099A

United States Patent [19]

Liu et al.

[11] Patent Number: 6,020,099

[45] Date of Patent: Feb. 1, 2000

[54] METHOD AND APPARATUS FOR FORMING AND REFINING TONER IMAGES IN AN ELECTROSTATIC PRINTING MACHINE

[75] Inventors: Chu-Heng Liu, Penfield; Weizhong Zhao, Webster, both of N.Y.

[73] Assignee: Xerox Corporation, Stamford, Conn.

[21] Appl. No.: 09/184,136

[22] Filed: Nov. 2, 1998

[51] Int. Cl.[7] ..... G03G 13/095; G03G 15/095

[52] U.S. Cl. ..... 430/97; 399/237; 399/296

[58] Field of Search ..... 430/97, 902; 399/296

[56] References Cited

U.S. PATENT DOCUMENTS

| | | | |
|---|---|---|---|
| 5,387,760 | 2/1995 | Miyazawa et al. | 399/239 |
| 5,436,706 | 7/1995 | Landa et al. | 399/238 |
| 5,539,506 | 7/1996 | Bean et al. | 399/296 |
| 5,619,313 | 4/1997 | Domoto et al. | 399/233 |
| 5,937,248 | 8/1999 | Liu et al. | 399/237 |

OTHER PUBLICATIONS

Xero Disclosure Journal, vol. 11, No. 6, Nov./Dec. 1986 p. 295.

*Primary Examiner*—Roland Martin
*Attorney, Agent, or Firm*—Tallam I. Nguti

[57] ABSTRACT

A method and apparatus for producing high quality toner images in an electrostatic printing machine. The method using the apparatus includes (a) (a) forming an initial developed toner image on a photoreceptor using a first toner image forming assembly including a charging device for uniformly charging the photoreceptor, and a development assembly, including charged toner solids having a single polarity, for image-wise applying a layer of the toner solids to the latent image to form an initial developed toner image; (b) refining the initial developed toner image using an air breakdown charging assembly, including a relatively large magnitude voltage biasing source and a nip forming roll coupled thereto, for image-wise recharging of the single polarity toner solids layer forming the initial developed toner image. The air breakdown charging assembly induces an air breakdown electrical discharge wherein free mobile ions are introduced into a vicinity of the initial developed toner image, and the latent image underlying the initial developed toner image cooperates with the large magnitude voltage biasing source to cause free mobile ions to flow to toner solids of the initial developed toner image in an image-wise manner, thereby image-wise recharging toner solids of the initial developed toner image such that image area toner solids then have a first polarity, and background toner solids then have a second and relatively opposite polarity; and (c) separating the image area toner solids from the background area toner solids, so as to refine the initial developed toner image, thereby resulting in a high resolution, high quality refined final toner image consisting of the image area toner solids having highly clean background areas.

11 Claims, 3 Drawing Sheets

METHOD AND APPARATUS FOR FORMING AND REFINING TONER IMAGES IN AN ELECTROSTATIC PRINTING MACHINE

RELATED CASES

This application is related to U.S. application Ser. No. 09/184,675, entitled "METHOD AND APPARATUS FOR DEVELOPING HIGH QUALITY IMAGES IN AN ELECTROSTATIC PRINTING MACHINE." filed on even date herewith; and U.S. application Ser. No. 09/184,674, entitled "METHOD AND APPARATUS FOR FORMING HIGH QUALITY IMAGES AN ELECTROSTATIC PRINTING MACHINE" filed on even date herewith; and each having at least one common inventor.

BACKGROUND OF THE INVENTION

This invention relates generally to electrostatography, and more particularly, concerns a method and apparatus for forming high quality images in an electrostatic printing machine.

Generally, processes for electrostatographic copying and printing are initiated by selectively charging and/or discharging a charge receptive imaging member in accordance with an original input document or an imaging signal, generating an electrostatic latent image on the imaging member. This latent image is subsequently developed into a visible image by a process in which charged developing material is deposited onto the surface of the latent image bearing member, wherein charged solids in the developing material adhere to image areas of the latent image. The developing material typically comprises carrier granules having charged marking or toner solids adhering triboelectrically thereto, wherein the toner solids are electrostatically attracted from the carrier granules to the latent image areas to create a powder toner image on the imaging member.

Alternatively, the developing material may comprise a liquid developing material comprising a carrier liquid having pigmented marking solids (or so-called toner solids) and charge director materials dispersed and/or dissolved therein (so-called carrier liquid), wherein the liquid developing material is applied to the latent image bearing imaging member with the marking solids being attracted to the image areas of the latent image to form a developed liquid toner image. Regardless of the type of developing material employed, the charged toner or marking solids of the developing material are electrostatically attracted to the latent image to form a visible developed image corresponding to the latent image on the imaging member.

The developed image is subsequently transferred, either directly or indirectly, from the imaging member to a copy substrate, such as paper or the like, to produce a "hard copy" output document. In a final step, the imaging member is cleaned to remove any charge and/or residual developing material therefrom in preparation for a subsequent image forming cycle.

The above-described electrostatographic printing process is well known and has been implemented in various forms in the marketplace to facilitate, for example, so-called light lens copying of an original document, as well as for printing of electronically generated or digitally stored images where the electrostatic latent image is formed via a modulated laser beam. Analogous processes also exist in other electrostatic printing applications such as, for example, ionographic printing and reproduction where charge is deposited in image-wise configuration on a dielectric charge retentive surface. It will be understood that the instant invention applies to all various types of electrostatic printing systems and is not intended to be limited by the manner in which the image is formed on the imaging member or the nature of the latent image bearing member itself.

As described hereinabove, the typical electrostatographic printing process includes a conventional development step whereby developing material including charged marking or toner solids is physically transported into contact with the imaging member so as to selectively adhere to the latent image areas thereon in an image-wise configuration. Development of the latent image is usually accomplished by electrical attraction of charged toner or marking solids to the image areas of the latent image. The development process is most effectively accomplished when the solids carry electrical charges opposite in polarity to the latent image charges, with the amount of toner or marking solids attracted to the latent image being proportional to the electrical field associated with the image areas. Some electrostatic imaging systems operate in a manner wherein the latent image includes charged image areas for attracting developer material (so-called charged area development (CAD), or "write white" systems), while other printing processes operate in a manner such that discharged areas attract developing material (so-called discharged area development (DAD), or "write black" systems).

The following disclosures may be relevant to some aspects of the present invention. U.S. Pat. No. 5,387,760 discloses a wet development apparatus for use in a recording machine to develop a latent image on a uniformly charged imaging carrier member toner image. The apparatus includes a development roller disposed in contact with or near the electrostatic latent image carrier and an application head for applying a uniform layer of the wet developer to the roller.

U.S. Pat. No. 5,436,706 discloses an liquid immersion development (LID) machine including a first member having a uniformly charged first surface having formed thereon a latent electrostatic image, wherein the latent electrostatic image includes image regions at a first voltage and background regions at a second voltage. A second member charged to a third voltage intermediate the first and second voltages is also provided, having a second surface adapted for resilient engagement with the first surface. A third member is provided, adapted for resilient contact with the second surface in a transfer region. The liquid immersion development (LID) machine also includes an apparatus for supplying liquid toner to the transfer region thereby forming on the second surface a thin layer of liquid toner containing a relatively high concentration of charged toner solids, as well as an apparatus for developing the latent image by selective transferring portions of the layer of liquid toner from the second surface to the first surface.

U.S. Pat. No. 5,619,313 discloses a method and apparatus for simultaneously developing and transferring a liquid toner image. The method includes the steps of moving a photoreceptor including a charge bearing surface having a first electrical potential, applying a uniform layer of charge having a second electrical potential onto the charge bearing surface, and image-wise dissipating charge from selected portions on the uniformly charged charge bearing surface to form a latent image electrostatically, such that the charge-dissipated portions of the charge bearing surface have the first electrical potential of the charge bearing surface. The method also includes the steps of moving an intermediate transfer member biased to a third electrical potential that lies between said first and said second potentials, into a nip forming relationship with the moving imaging member to form a process nip. The method further includes the step of introducing charged liquid toner having a fourth electrical potential into the process nip, such that the liquid toner sandwiched within the nip simultaneously develops image portions of the latent image onto the intermediate transfer member, and background portions of the latent image onto the charge bearing surface of the photoreceptor.

Image quality is a concern with all electrostatographic printing applications or toner image forming methods including the conventional exemplary methods discussed above. In such methods, image quality in electrostatographic printing applications may vary significantly and unacceptably due to numerous conditions affecting latent image formation as well as development, among various other factors. In particular, image development can be effected by charge levels, both in the latent image, as well as in the developing material. For example, when the charge on dry toner solids becomes significantly depleted, binding forces with the carrier also become depleted, causing an undesirable increase in image development, which, in turn, causes the development of the latent image to spread beyond the area defined thereby. The unacceptable result is often unwanted toner solids in background or non-image areas.

Costly and high precision charging and development devices are often not desirable solutions to unacceptable image quality. There is therefore, for example, an ongoing need for a method and apparatus for forming high quality toner images in a printing machine that do not result in images having poor quality backgrounds.

SUMMARY OF THE INVENTION

In accordance with one aspect of the present invention, there is provided a method of producing high quality images in an electrostatic printing machine. The method includes (a) forming an initial developed toner image on a photoreceptor using initial developed toner image forming assemblies including a charging device for uniformly charging the photoreceptor, and a development assembly including charged toner solids having a single polarity for image-wise applying a layer of such toner solids to the latent image to form an initial developed toner image; and (b) refining the initial developed toner image using an air breakdown charge and development (ABCD) assembly. The ABCD assembly includes a relatively large magnitude voltage biasing source, and a nip forming roll coupled thereto and forming a toner solids recharging nip with the photoreceptor, for image-wise recharging of the single polarity toner solids layer forming the initial developed toner image, by inducing an image-wise air breakdown electrical discharge in which free mobile ions are introduced into the vicinity of the initial developed toner image. The latent image underlying the initial developed toner image cooperates with the large magnitude voltage biasing source to cause free mobile ions to flow to the toner solids of the initial developed toner image in an image-wise manner corresponding to the underlying latent image. This, in turn, leads to image-wise recharging of the toner solids layer of the initial developed toner image resulting in image area toner solids then having a first polarity, and background toner solids then having a second and relatively opposite polarity. The method of the present invention then includes separating the image area toner solids from the background area toner solids, thereby resulting in a high resolution, high quality, clean background refined final toner image consisting of the image area toner solids.

In accordance with another aspect of the present invention, there is provided a liquid immersion development (LID) machine, for producing high resolution, high quality toner images. The LID machine includes a photoreceptor for having a photoconductive surface capable of supporting a latent image and toner solids marking material; a charging device for applying a uniform layer of charge on the photoconductive surface to produce a uniformly charged surface; an exposing device for image-wise exposing portions of the uniformly charged surface forming a latent image including image areas having a first charge level, and background areas having a second charge level; a development apparatus including liquid developer material containing liquid carrier and charged, single polarity toner solids for contacting the image areas and the background areas of the latent image, and for image-wise forming an initial developed toner image including image areas having wanted single polarity toner solids and background areas having some unwanted single polarity toner solids therein; an air breakdown charging assembly, including a relatively large magnitude voltage biasing source, and a nip forming roll coupled thereto and forming a toner solids recharging nip with the photoreceptor, for image-wise recharging of the single polarity toner solids forming the initial developed toner image. The air breakdown charging assembly is useful for inducing an air breakdown electrical discharge wherein free mobile ions are introduced into a vicinity of the initial developed toner image, and the latent image underlying the initial developed toner image cooperates with the large magnitude voltage biasing source to cause free mobile ions to flow to the toner solids of the initial developed toner image in an image-wise manner, thereby image-wise recharging such toner solids such that wanted toner solids in image areas then have a first polarity, and unwanted toner solids in background areas then have a second and relatively opposite polarity. The LID machine then includes a separator member for separating the unwanted toner solids in background areas having the second and opposite polarity from wanted toner solids in image areas, thereby producing a refined final toner image, of wanted toner solids, having a high resolution, sharp image area edges and high quality clean background areas.

BRIEF DESCRIPTION OF THE DRAWINGS

These and other aspects of the present invention will become apparent from the following description in conjunction with the accompanying drawings in which.

DETAILED DESCRIPTION OF THE INVENTION

Figure 1:
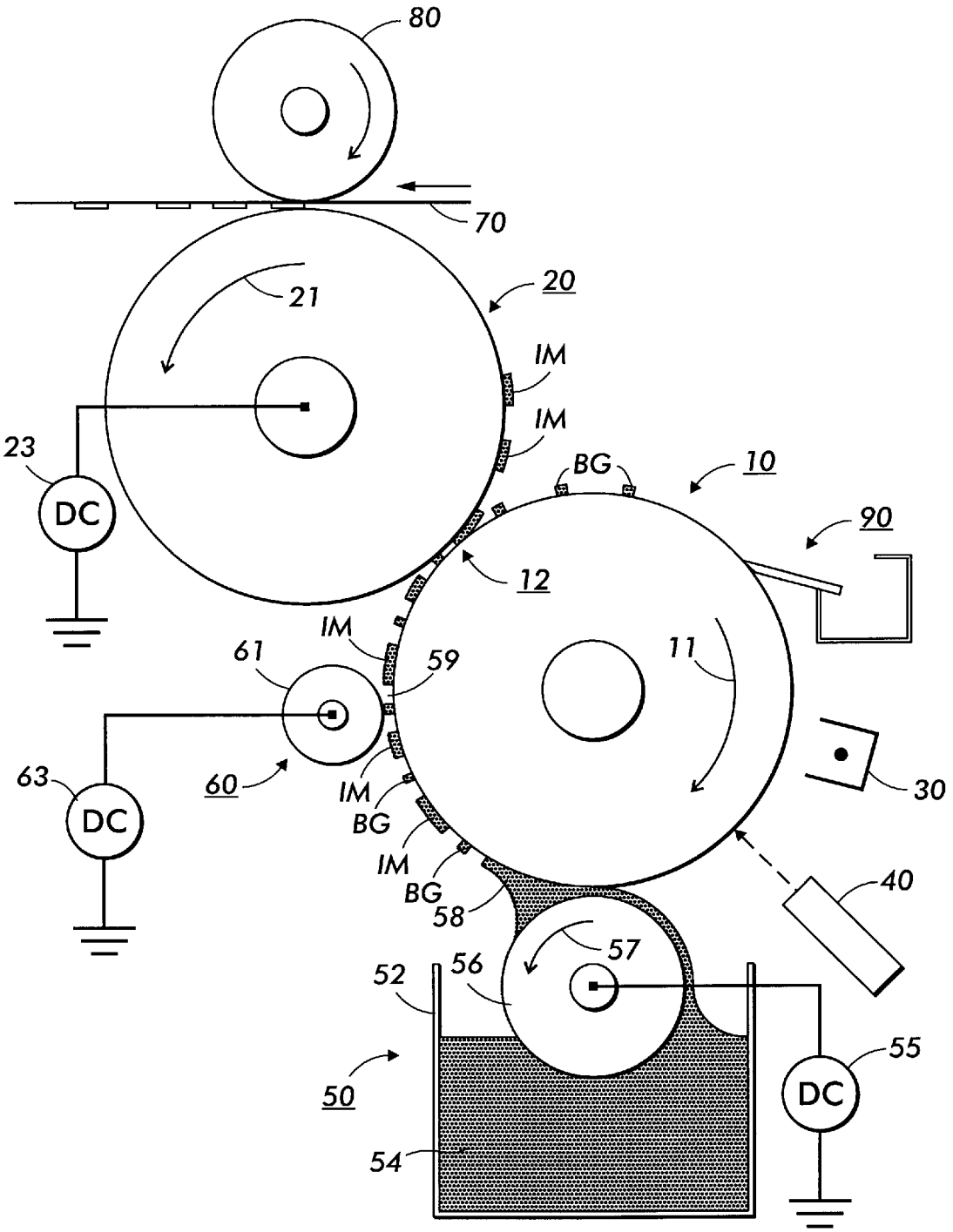
FIG. 1 is a schematic illustration of a liquid immersion development (LID) electrostatic machine in accordance with the present invention, including a first series of toner image forming assemblies, and a second stage air breakdown charge and development (ABCD) assembly with separator device for refining the initial developed toner image so as to produce a high quality toner image in accordance with the present invention.

For a general understanding of the features of the present invention, reference is made to the drawings, wherein like reference numerals have been used throughout to identify the same or similar elements. Although the following description will be directed to a liquid immersion development (LID) machine, it will be understood that the present invention contemplates the use of various alternative embodiments for the initial development of a toner image, as are well known in the art of electrostatographic copying and printing, including, for example, but not limited to, liquid toner development and dry toner development. On the contrary, the following description is intended to cover all alternatives, modifications, and equivalents, as may be included within the spirit and scope of the invention as if defined by the appended claims.

Referring now to FIG. 1, the liquid immersion development (LID) machine of the present invention for forming relatively high quality toner images in accordance with the present invention is shown generally as 8. As shown, the LID machine 8 includes a first stage series of assemblies of operatively associated image forming and refining elements in accordance with the present invention, including an imaging member 10. Imaging member 10 includes an imaging surface 13 of any type capable of having an electrostatic latent image formed thereon. An exemplary imaging member 10 may include a typical photoconductor or other photoreceptive component of the type known to those of skill in the art in electrophotography, wherein an imageable surface having photoconductive properties is supported on a conductive support substrate.

Although the following description will be directed to a photoconductive imaging member, it will be understood that the present invention contemplates the use of various alternative embodiments for an imaging member as are well known in the art of electrostatographic printing, including, for example, but not limited to, non-photosensitive imaging members such as a dielectric charge retaining member of the type used in ionographic printing machines, or electroded substructures capable of generating charged latent images.

Photoreceptor 10 is rotated, as indicated by arrow 11, so as to transport the surface 13 thereof in a process direction for implementing first stage and second stage series of image forming and refining steps in accordance with the present invention.

Initially, as shown in FIG. 1, the photoconductive surface 13 of photoreceptor 10 passes through a series of initial toner image forming assemblies including a first charging assembly 30, an exposure assembly 40 and a development assembly 50, for forming an initial developed toner image 58. The first charging assembly may include a corona generating device 30 or any other charging apparatus for applying an electrostatic charge to the surface of the photoreceptor 10. The corona generating device 30 is provided for charging the photoconductive surface of photoreceptor 10 to a relatively high, substantially uniform potential. It will be understood that various charging devices, such as charge rollers, charge brushes and the like, as well as induction and semiconductive charge devices among other devices which are well known in the art may be utilized at the charging assembly for uniformly applying a charge potential to the surface of the photoreceptor 10.

After the photoreceptor 10 is brought to a substantially uniform charge potential, the charged surface 13 thereof is advanced to an image exposure assembly, identified generally by reference numeral 40. The image exposure assembly 40 projects a light image corresponding to an input image, to be reproduced, onto the charged photoconductive surface. The light image selectively dissipates the charge in portions thereof for recording a first latent image on the photoconductive surface in image configuration corresponding to the input image. The first latent image thus includes image areas having a first charge voltage, and background areas having a second charge voltage.

The image exposure assembly 40 may incorporate various optical image formation and projection components as are known in the art. For example, it may include various well known light lens apparatus or digital scanning systems for forming and projecting an image from an original input document onto the photoreceptor 10. Alternatively, various other electronic devices available in the art may be utilized for generating electronic information to create the electrostatic latent image on the imaging member.

The photoreceptor 10 then moves the first latent image on its surface to a conventional development assembly 50 where both the image areas and background areas of the latent image are contacted with liquid developer material 54 so as to develop or make the first latent image visible with charged toner solids contained in the liquid developer material 54. As shown, the development assembly 50 includes a housing 52 that holds the liquid developer material 54 containing charged toner solids. The assembly 50 includes an applicator roll 56 that is biased by a source 55 for causing image-wise development or toner solids transfer from the applicator 56 to the first latent image on photoreceptor 10. The electrical bias from the source 55 is of a magnitude intended to cause toner solids to be transported from the applicator 56 to image areas of the first latent image, but ordinarily not to the background areas thereof, however some toner solids do undesirably transfer to background areas.

Importantly, the toner solids are charged so they have a toner potential that is suitable for neutralizing, only partially, the charge in the image areas being developed. For example, where the image areas being developed were charged to +800v and remain at +800v after exposure to dissipate background areas to zero volts, a suitable voltage or potential for the toner solids will be −400v. The −400v toner solids when developed onto the +800v image area, will partially reduce the image area voltage to +400v, a 50% partially neutralization. The +400v is the residual potential between image areas and background areas at zero volts.

As shown, the applicator roll 56 rotates in the direction of the arrow 57 and transports a layer of the developer material 54 into contact with the first latent image on the surface of the photoreceptor 10. The latent image is thus developed as such by selectively attracting the charged toner solids onto image areas of the latent image to form an initial developed toner image 58 having wanted toner solids IM in image areas of the latent image, and some unwanted toner solids BG in background areas thereof.

The unwanted toner solids BG in the background areas of course represent poor or unacceptable image quality, as discussed for example in the background portion of this specification. In accordance with an aspect of the present invention, such poor image quality may be arrived at intentionally by using less costly, low latitude first stage series of assemblies 40, 50 as above., for forming the initial developed toner image. Ordinarily however, such poor image quality results from conventional initial developed toner image forming methods, particularly from conventional development methods as carried out with the development assembly 50.

As pointed out in the background portion of this specification, image quality concerns and problems are due to numerous conditions arising, for example, from latent image formation at the exposure assembly 40, and in particular from toner development at the development assembly 50. The predictably poor or relatively low quality result usually is the transfer or development of unwanted toner solids BG onto the background areas of the first latent image when the entire latent image (image areas and background areas thereof) is contacted, as above, with developer material by the development assembly 50. If the initial developed toner image 58 (image areas and background areas) to be transferred as such unrefined, onto a sheet of paper, it will clearly and undesirably include on such sheet of paper, such unwanted toner solids BG in the background areas.

However, in accordance with the present invention, any unwanted toner solids BG in background areas will be recharged and removed or significantly reduced by the second stage toner image refining assembly or air breakdown charge and development (ABCD) assembly mounted downstream of the development apparatus 50. In addition, other image defects known as edge smearing due to toner spreading over the image-background boundary onto the background area, such as dragout in liquid immersion development, will be significantly reduced or eliminated, advantageously resulting in high resolution and sharp edges for wanted toner solids in image areas of the final toner image, even if the initial developed toner image was only an ordinary low latitude developed toner image having significant unwanted background toner solids BG.

Figure 2:
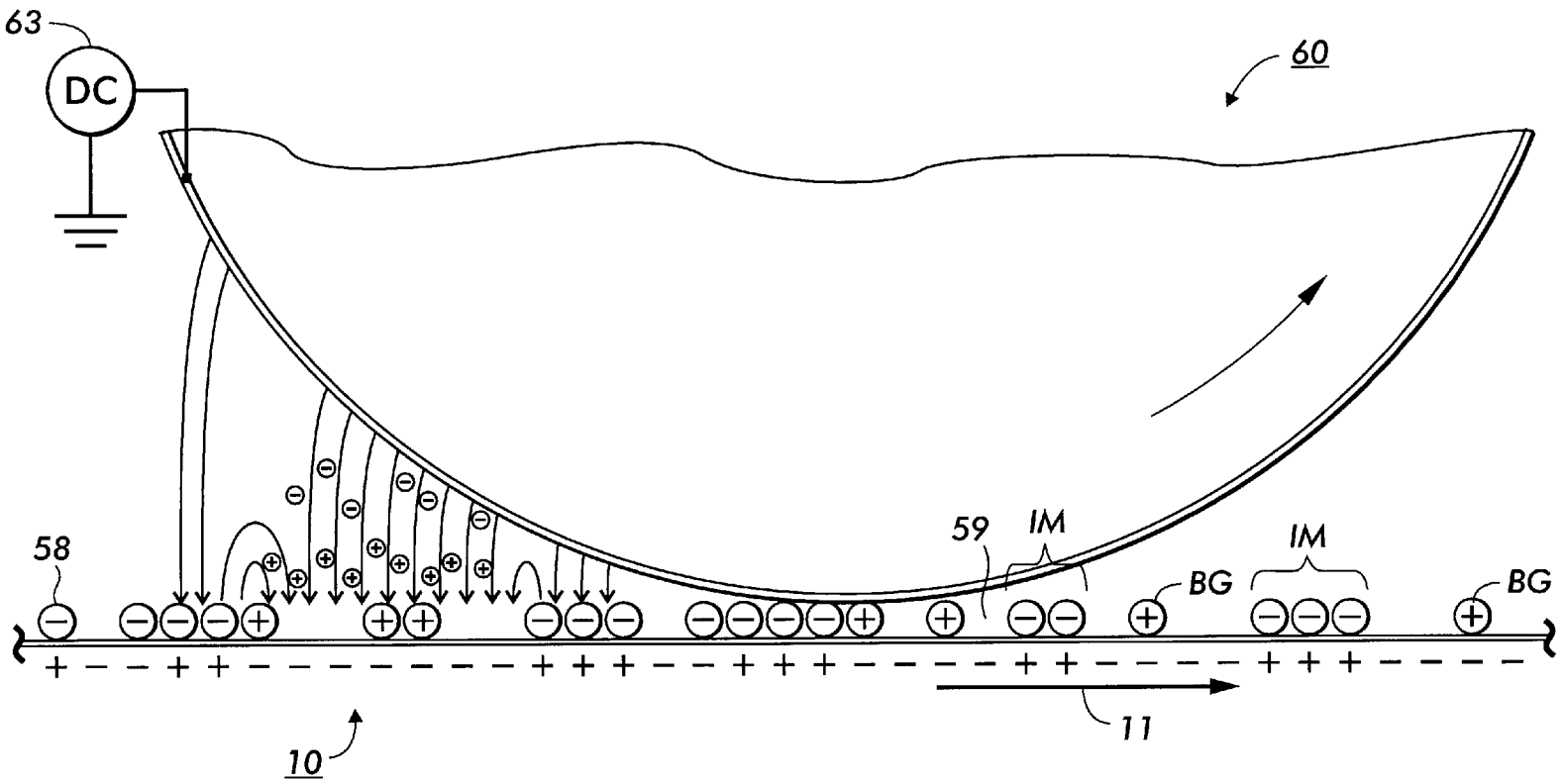
FIG. 2 is an exploded view illustrating the image-wise initial developed toner image being recharged by the second stage ABCD assembly of FIG. 1 in accordance with the present invention.

Referring now to FIGS. 1 and 2, the second, ABCD air breakdown device of the second stage series of toner image refining assembly of the present invention, is illustrated. Method and apparatus for ABCD (Air Breakdown Charge and Development) used as a primary, first stage method an apparatus for forming an initial developed toner image are disclosed for example in U.S. application Ser. No. 08/884,236, filed Jun. 27, 1997 in the name of the current inventors, (relevant parts of which are incorporated herein by reference). As disclosed therein, ABCD employs latent image formation, uniform, none image-wise coating of the photoreceptor with toner solids forming a layer, air breakdown biasing and image-wise recharging of the toner layer, and image-wise separation of image area toner solids from background area toner solids to form a desired toner image.

Specifically, the ABCD method and apparatus is directed to a toner image forming method and apparatus, whereby image-wise charging or recharging of a single polarity toner solids layer coating an underlying electrostatic latent image on a charged photoreceptor is accomplished by inducing an air breakdown electrical discharge in which free mobile ions are introduced into the vicinity of the toner solids layer. The underlying latent image causes the free mobile ions to flow to the toner solids layer in an image-wise ion stream corresponding to the latent image, which, in lo turn, leads to image-wise charging or recharging of the toner solids layer, such that the toner solids layer itself then has image area toner solids having a first polarity and background toner solids having a second and relatively opposite polarity. The image-wise recharged toner solids layer is subsequently developed by separating image area toner solids from background area toner solids. The image area toner solids are then transferred to a copy substrate as an output document. In the present invention, the initial developed toner image 58 is used in place of a uniform toner solids layer, and the ABCD method and apparatus are used, not as primary toner image forming method, but as a secondary process for refining an initially developed toner image.

Referring now to FIGS. 1 and 2, after conventional toner image development by the development unit 50 as a first process in accordance with the present invention, the second, image refining process is carried out with an air breakdown charge development assembly 60 comprising a relatively high air breakdown bias source 63 coupled to a nip forming roll 61 shown forming a toner image recharging nip 59 with the photoreceptor surface 13. The ABCD assembly 60 advantageously provides for better voltage control. The polarity of the air breakdown bias source 63 preferably should be relatively same as that of the image areas and opposite that of the background areas. The value of the bias source 63 should be set high enough in order to cause air breakdown at the entrance into the nip 59 only between the biased roll 61 and the background areas, as such background areas enter the toner image refining nip 59. Because of the relative sameness of polarity of the source 63 and image area toner solids, there is advantageously no air breakdown between the biased roll 61 and image areas, as such image areas enter the toner image recharging nip 59. Such image-wise air breakdown (in background areas but not in image areas) causes a reversal of the polarity of the charge on toner solids in the background areas, and thus prevents the transfer of such toner solids along with image area toner solids.

In an experimental demonstration, a photoreceptor was uniformly charged to −500V, and then image-wise exposed (DAD discharged Area Development) to form a latent image having discharged image areas at about zero volts, and background areas at the −500V level. In a first stage initial toner image forming process in accordance with the present invention, the whole latent image (image areas and background areas) was then brought into contact with liquid developer material or ink that included negatively charged toner solids, using a development bias of −500V. The result was a poor or low quality initial developed toner image on the photoreceptor that included severe background problems in the form of a significant level of toner solids in the background areas.

In a second stage of the experimental demonstration involving toner image refining in accordance with the present invention, an air breakdown roll such as 60 is biased at +500V and brought into nip contact with the poor quality initial developed toner image on the photoreceptor, in order to form a toner image recharging nip therewith. As expected, air breakdown occurred between the biased roll at +500V and the negatively charged background areas at −500V, thus reversing the polarity of charge on any toner solids in such background areas from negative to positive. Such charge reversal effectively creates a charge polarity contrast between the charge on toner solids IM in the image area, and that on those BG in the background areas.

In order to achieve good image refining, a strong image-wise force is required. Therefore, a strong image-wise field is desired. As will be understood, the latent image contrast is the origin of the image-wise field, substantial residual latent image contrast after the initial toner image development must remain to enable the image refining process. Therefore after formation of the initial developed toner image 58, substantial residual potential difference or contrast must exist between the image areas IM and background areas of the image 58. It is preferable that such a residual potential difference or contrast have an absolute magnitude of plus or minus 200v, and should be greater than one-third of the original or latent image potential contrast, (that is the difference between the potential of the charged and discharged areas of the first latent image). In addition, it also preferable that the residual potential contrast should be less than two-thirds of that original potential contrast in order to facilitate the second stage refining step of the present invention. This is in distinct contrast to conventional development processes in which an original, latent image potential contrast or difference in charge levels between charged and discharged areas usually is completely neutralized when charged toners reduce or increase the potential of the image areas so that they then equal that of background areas.

Due to the process latitude provided by the image refining process, the initial image development can operate in such a way to maximize the system performance. Conventionally, high speed development is difficult to achieve due to the limited toner mobility and development field. The great tolerance acceptable for forming of the initial developed toner image 58 in accordance with the current invention advantageously enables much greater development field and faster development. Even though the background quality and drag-out (as in liquid immersion development) are comparatively worse in the first stage, the second image refining process cures most of such image defects, and enables high speed development.

Thus it should be noted that in accordance with the present invention, when the first stage of conventional development is carried out, a substantial voltage difference or contrast remains between the voltage or potential of toned or developed image areas and the potential or voltage of the background areas. In the second process or toned image refining stage, this remaining voltage difference or contrast is effectively relied on and used in an image-wise recharging step for reversing the charge on toner solids BG in the background areas. As a result of this recharging step, the polarity of toner solids BG in background areas is reversed, and thus such toner solids BG are substantially unlikely to transfer along with toner solids (IM) in image areas. As a consequence, the transferred refined toner image areas IM have sharp edges, relatively higher resolution and highly clean background areas.

To summarize, in conventional development, as practiced at 50 (FIG. 1) in the first initial stage of the present invention, there are always some image defects such as unwanted toner solids BG in background areas. Additionally, such defects for example include high background and drag-out (in LID). Typically, a lot of effort and cost are spent towards minimizing such defects, and as a result, the development apparatus and process latitudes are often required to be very tight. Because the effects of such defects are often cumulative, the developed or initial developed toner image is typically substantially worse in resolution than the latent image from which it is developed or toned. Thus in accordance with the present invention, what amount to two development processes or stages (initial toner image development, and ABCD toner image refining) are provided for first forming a low quality initial developed toner image conventionally, and then subsequently processing or refining the low quality initial developed toner image into a high resolution, high quality final toner image.

In the second stage, toner solids in image areas and toner solids in background areas are treated differently in an image-wise manner in order to obtain opposite charge polarities therebetween before a separation step where toner solids in the image areas (IM) are separated in a two surface nip onto one surface, from toner solids in the background areas.

Referring again to FIG. 1, once the initial developed toner image 58 is image-wise recharged by the ABCD assembly 60, the photoreceptor 10 is advanced to an image separator 20 forming an image transfer nip 12 with the photoreceptor 10, and rotating as shown by arrow 21. Image separator 20 may be provided in the form of a biased roll member having a surface adjacent to the surface of the photoreceptor 10 and preferably contacting the recharged initial developed toner image 58 residing on photoreceptor 10. An electrical biasing source 23 is coupled to the image separator 20 to bias the image separator 20 so as to attract either image area toner solids IM or background area toner solids BG of the recharged initial developed toner image 58, thereby simultaneously separating and refining the initial developed toner image 58 into a final refined toner image consisting of image area toner solids IM on one surface, and background area toner solids BG on the other surface.

In the embodiment of FIG. 1, the image separator 20 is biased with a polarity opposite the charge polarity of the image areas IM in the initial developed toner image 58, so as to enable it to attract such image areas IM from the photoreceptor 10, resulting in a final refined toner image made up of selectively separated and transferred image areas IM. The background image byproduct, toner solids BG, are thus left on the surface of the photoreceptor 10 for removal by a cleaning unit 90. Alternatively, the image separator 20 can be provided with an electrical bias having a polarity appropriate for attracting background areas BG away from the photoreceptor 10, thus maintaining image area toner solids IM corresponding to the final refined toner image on the surface of the imaging member.

Figure 3:
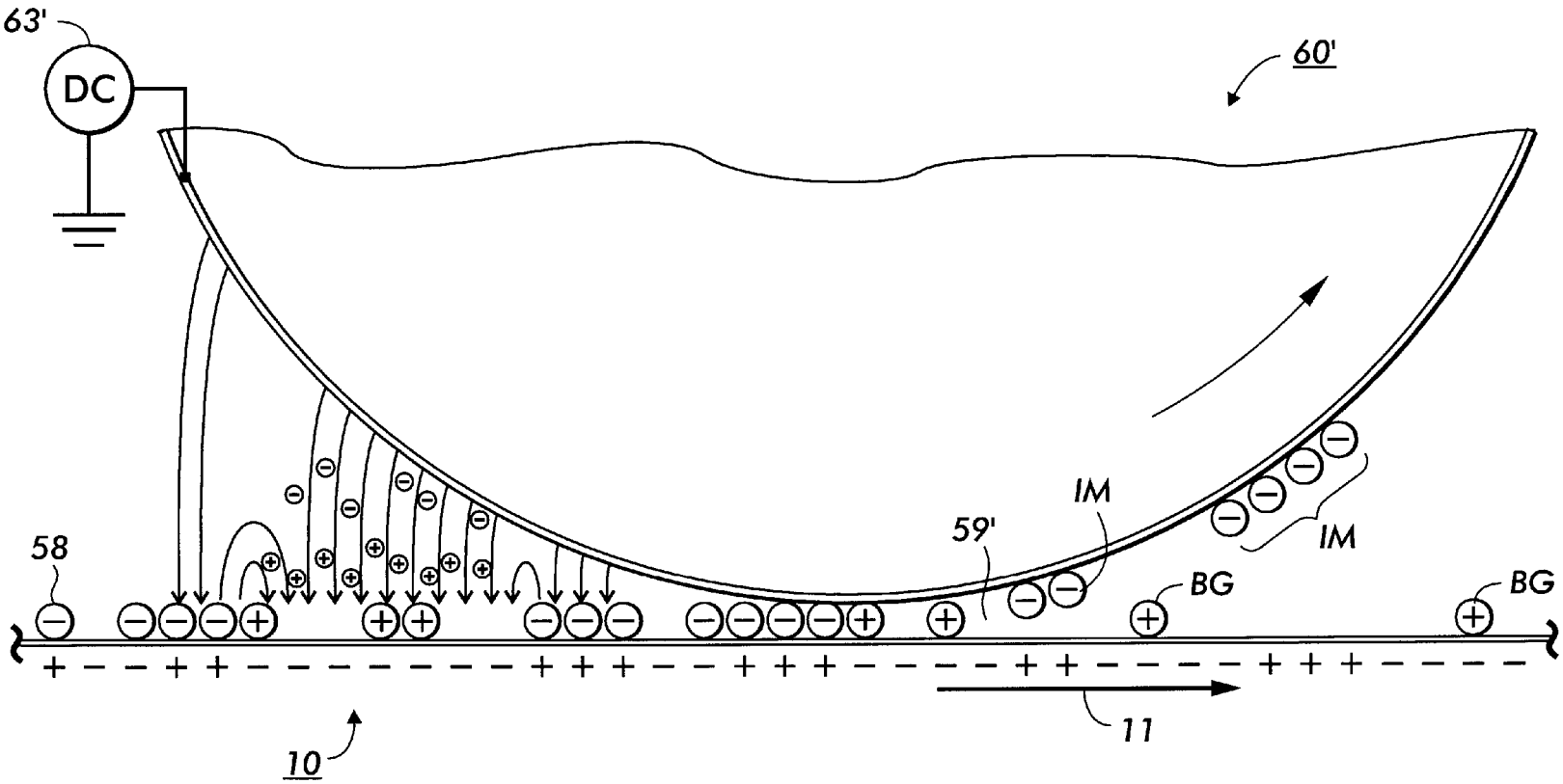
FIG. 3 is an exploded view illustrating another simplified embodiment of the current invention including a combined image refining and transfer process step.

Referring now to FIGS. 1 and 3, another embodiment of the present invention is illustrated. In this embodiment, an ABCD device 60' biased by an appropriate source 63' also performs the function of the separation roll 20 of (FIG. 1). In this embodiment, a single nip 59' accomplishes both ABCD toner image recharging and image/background toner solids separation, thus two separate functions are achieved at the nip entrance and nip exit respectively.

As shown in FIG. 3, a toner image recharging and separating member 60' biased at +500V by the source 63' for example, is brought into nip contact with the poor quality initial developed toner image 58 on the photoreceptor 10, in order to form a toner image recharging nip 59' therewith. As expected, air breakdown occurs between the biased member 60' at +500V and negatively charged background areas at −500V, thus reversing the polarity of charge on toner solids BG in these background areas from negative to positive. Such charge reversal effectively prevents the now positively charged toner solids BG from transferring onto the biased member 60' along with the negatively charged toner solids IM of the image areas. The resulting refined, final image on the biased member 60' is thus a toner image having a relatively higher resolution and higher quality when compared to the initial poor quality toner image produced after the first process only.

After the final refined toner image is created as above, (either on the surface of a biased ABCD roll 60' or on the surface of a separator 20), it may then be transferred from there to a copy substrate 70 via any means known in the art, which may include an electrostatic transfer apparatus including a corona generating device of the type previously described or a biased transfer roll. Alternatively, a pressure transfer system may be employed which may include a heating and/or chemical application device for assisting in the pressure transfer and fixing of the developed image on the output copy substrate 70. In yet another alternative, image transfer can be accomplished via surface energy differentials wherein the surface energy between the image and the member supporting the image prior to transfer is lower than the surface energy between the image and the substrate 70, inducing transfer thereto.

In a preferred embodiment, as shown in FIG. 1, the final refined toner image is transferred to a copy substrate via a heated pressure roll, whereby pressure and heat are simultaneously applied to the image to simultaneously transfer and fuse the image to the copy substrate 70. It will be understood that separate transfer and fusing systems may be provided, wherein the fusing or so-called fixing system may operate using heat (by any means such as radiation, convection, conduction, induction, etc.), or other known fixation process which may include the introduction of a chemical fixing agent. Since the art of electrostatographic printing is well known, it is noted that several concepts for transfer and/or fusing which could be beneficially used in combination with the image-wise charging system of the present invention have been disclosed in the relevant patent literature.

It is, therefore, evident that there has been provided, in accordance with the present invention a high resolution, high quality toner image producing method and apparatus that fully satisfy the aspects of the invention hereinbefore set forth. While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

We claim:

1. A method of producing high quality toner images in an electrostatic printing machine, the method comprising the steps of:

(a) forming an initial developed toner image on a photoreceptor using a first toner image forming assembly including a charging device for uniformly charging the photoreceptor, and a development assembly, including charged toner solids having a single polarity, for image-wise applying a layer of the toner solids to the latent image to form an initial developed toner image;

(b) refining the initial developed toner image using an air breakdown charging assembly, including a relatively large magnitude voltage biasing source and a nip forming roll coupled thereto, for image-wise recharging of the single polarity toner solids layer forming the initial developed toner image, the air breakdown charging assembly inducing an air breakdown electrical discharge wherein free mobile ions are introduced into a vicinity of the initial developed toner image, and the latent image underlying the initial developed toner image cooperating with the large magnitude voltage biasing source to cause free mobile ions to flow to toner solids of the initial developed toner image in an image-wise manner, thereby image-wise recharging toner solids of the initial developed toner image such that image area toner solids then have a first polarity, and background toner solids then have a second and relatively opposite polarity; and (c) separating the image area toner solids from the background area toner solids, so as to refine the initial developed toner image, thereby resulting in a high resolution, high quality refined final toner image consisting of the image area toner solids having highly clean background areas.

2. An electrostatic printing machine, for producing high resolution, high quality toner images, the electrostatic printing machine comprising:

(a) a photoreceptor having a photoconductive surface capable of supporting a latent image and toner solids marking material;

(b) a charging device for applying a uniform layer of charge on said photoconductive surface to produce a uniformly charged surface;

(c) an exposing device for image-wise exposing portions of said uniformly charged surface forming a first latent image including image areas having a first charge level, and background areas having a second charge level;

(d) a development apparatus including developer material containing charged, single polarity toner solids for contacting said image areas and said background areas of said first latent image, and for image-wise forming an initial developed toner image including image areas having wanted said single polarity toner solids and background areas having some unwanted said single polarity toner solids therein; and (e) an air breakdown charging (ABCD) assembly for image-wise recharging of said single polarity toner solids forming said initial developed toner image, said ABCD assembly including a relatively large magnitude voltage biasing source, and a nip forming roll coupled to said large magnitude biasing source and forming a toner solids recharging nip with said photoreceptor, and said ABCD assembly inducing an air breakdown electrical discharge wherein free mobile ions are introduced into a vicinity of said initial developed toner image, and said first latent image underlying said initial developed toner image cooperating with said large magnitude voltage biasing source to cause free mobile ions to flow to toner solids of said initial developed toner image in an image-wise manner, thereby image-wise recharging toner solids of said initial developed toner image such that wanted toner solids in image areas then have a first polarity, and unwanted toner solids in background areas then have a second and relatively opposite polarity.

3. The electrostatic printing machine of claim 2, including a separate separator member mounted downstream of said air breakdown charging assembly for separating said unwanted toner solids in background areas having the second and opposite polarity from wanted toner solids in image areas, thereby producing a refined final toner image, of wanted toner solids, having a high resolution, sharp image area edges and high quality clean background areas.

4. The electrostatic printing machine of claim 2, wherein said large magnitude voltage biasing source has a polarity that is the same as that of said single polarity toner solids of said liquid developer material.

5. The electrostatic printing machine of claim 4, wherein said large magnitude voltage biasing source is sufficiently large relative and opposite to a polarity of background areas of said initial developed toner image so as to cause air breakdown between said ABCD assembly and said background areas of the initial developed toner image.

6. The electrostatic printing machine of claim 5, wherein air breakdown between said ABCD assembly and said background areas of the initial developed toner image occurs at an entrance of said toner solids recharging nip when said background areas of said initial developed toner image are entering said toner solids recharging nip.

7. The electrostatic printing machine of claim 6, wherein air breakdown between said ABCD assembly and said background areas of the initial developed toner image reverses charge polarity of unwanted toner solids in said background areas.

8. A method for producing high quality toner images in an electrostatic printing machine, the method, comprising the steps of:

(a) using a charging device to uniformly charge a photoconductive surface of a moving photoreceptor;

(b) image-wise exposing said photoconductive surface to generate a latent image thereon, said latent image including image areas having a first charge potential and background areas having a second and different charge potential so as to create an original potential contrast between image areas and background areas of the latent image;

(c) image-wise developing said latent image by contacting both image areas and background areas of said latent image with developer material containing charged toner solids to form an initial developed toner image having some unwanted toner solids in said background areas, the charged toner solids having a voltage suitable for partially neutralizing the voltage contrast between image areas and background areas;

(d) refining the initial developed toner image using an air breakdown charging assembly, including a relatively large magnitude voltage biasing source and a nip forming roll coupled thereto, for image-wise recharging of the single polarity toner solids layer forming the initial developed toner image, the air breakdown charging assembly inducing an air breakdown electrical discharge wherein free mobile ions are introduced into a vicinity of the initial developed toner image, and the latent image underlying the initial developed toner image cooperating with the large magnitude voltage biasing source to cause free mobile ions to flow to toner solids of the initial developed toner image in an image-wise manner, thereby image-wise recharging toner solids of the initial developed toner image such that image area toner solids then have a first polarity, and background toner solids then have a second and relatively opposite polarity; and (e) separating the image area toner solids from the background area toner solids, so as to refine the initial developed toner image, thereby resulting in a high resolution, high quality refined final toner image consisting of the image area toner solids having highly clean background areas.

9. The method of claim 8, wherein said image-wise developing step includes using developer material containing charged toner solids having a potential suitable for partially neutralizing potential in image areas so as to result in a residual potential contrast of about 200v between developed image areas and undeveloped background areas of the initial developed toner image.

10. The method of claim 8, wherein said image-wise developing step includes using developer material containing charged toner solids having a potential suitable for partially neutralizing potential in image areas so as to result in a residual potential contrast that is greater than one-third of an original potential contrast between image areas to be developed and background areas of the latent image being developed into the initial developed toner image.

11. The method of claim 8, wherein said image-wise developing step includes using developer material containing charged toner solids having a potential suitable for partially neutralizing potential in image areas so as to result in a residual potential contrast that is less than two-thirds of an original potential contrast between image areas to be developed and background areas, of the latent image being developed into the initial developed toner image.

* * * * *